US006367158B1

(12) United States Patent
Keatch

(10) Patent No.: US 6,367,158 B1
(45) Date of Patent: Apr. 9, 2002

(54) SUNDIAL

(76) Inventor: Richard Keatch, Unit 27, Frederick St. Centre, Aberdeen AB2 1HY (GB)

( * ) Notice: Subject to any disclaimer, the term of this patent is extended or adjusted under 35 U.S.C. 154(b) by 0 days.

(21) Appl. No.: 09/491,783

(22) Filed: Jan. 26, 2000

(30) Foreign Application Priority Data

Feb. 5, 1999 (GB) ..... 9902547
Nov. 16, 1999 (GB) ..... 9927095

(51) Int. Cl.[7] ..... G04B 49/02
(52) U.S. Cl. ..... 33/270
(58) Field of Search ..... 33/269, 268, 270, 33/271

(56) References Cited

U.S. PATENT DOCUMENTS 4,255,864 A * 3/1981 Glendinning ..... 33/270
4,656,748 A 4/1987 Thual ..... 33/270
4,782,472 A 11/1988 Hines ..... 33/270
5,590,093 A * 12/1996 Scharstein et al. ..... 33/270
5,596,553 A * 1/1997 Kellogg ..... 33/270
5,732,473 A * 3/1998 Gagnon ..... 33/270

FOREIGN PATENT DOCUMENTS

DE 23 48 435 4/1975
FR 2467427 * 5/1981 ..... 33/269
WO WO-94003844 A1 * 2/1994 ..... 33/270

* cited by examiner

*Primary Examiner*—Christopher W. Fulton
(74) *Attorney, Agent, or Firm*—Factor & Partners

(57) ABSTRACT

A sundial for indicating the time of day using the position of the sun having a labyrinthine body with a plurality of pathways connecting a first and said second face, each pathway being adapted either to transmit said ray of light from an entry end at the first face to an exit end at the second face or to absorb said ray of light depending on the solar position so that the second face indicates visibly the time of day.

23 Claims, 5 Drawing Sheets

SUNDIAL

The present invention relates to a sundial.

As the position of the Earth relative to the sun changes as the Earth rotates about its axis, the sun appears to move from east to west in the sky at approximately 15° per hour. Traditional sundials utilise this change in solar position to indicate the time of day by relying in general on a gnomon to cast a shadow onto a flat graduated surface. Such traditional sundials are normally constructed for outdoor use and a visible indication of the time of day is given by the proximity of the shadow to the various hour line graduations. In general, there is a limited range and variety of sundial constructions available due in part to the technical challenges involved in correlating solar position to a recognisable indication of the time of day. Moreover traditional sundials are generally unsuitable for indoor use. The present invention is based on a significant departure from the traditional sundial constructions which may be used indoors.

Thus viewed from one aspect the present invention provides a sundial for indicating the time of day using the position of the sun having a labyrinthine body comprising;

a first face capable of admitting a ray of light from each solar position in a substantially southeriy direction, a second face adapted to visibly receive said ray of light;

wherein said labyrinthine body is provided with a plurality of pathways connecting said first and said second face, each pathway being adapted either to transmit said ray of light from an entry end at the first face. to an exit end at the second face or to absorb said ray of light depending on the solar position, whereby the second face indicates visibly the time of day.

The sundial of the invention is particularly suitable for indoor use for example in front of a south facing window.

In a preferred embodiment, the labyrinthine body comprises a plurality of discrete layers. Each layer may comprise one or more pathways (eg tunnels, channels and the like) capable of transmitting a ray of light from a specific solar position (or a number of specific solar positions) from an entry end to an exit end on first and second faces of the sundial respectively.

In a particularly preferred embodiment, the labyrinthine body comprises at least five discrete horizontal layers. The first, third and fifth layers each comprise a pathway constructed so that the exit ends are horizontally positioned substantially directly above one another on the second face of the sundial. The second and fourth layers each comprise three pathways constructed so that the exit ends are vertically positioned on the second face of the sundial. Whilst the first, third and fifth layers may be generally narrow, the second and fourth layers are generally thicker.

Whilst five layers are generally the minimum required in accordance with the above embodiment, any number of other layers may be added as required. For example, seven layers is preferable and in this case the outermost layers are provided for capping the five innermost functional layers.

In one embodiment, separating means may be placed intermediate each of the discrete layers making up the labyrinthine body. These may take the form of thin layers of material, the surface of which is preferably.reflective.

The labyrinthine body may have a generally spherical configuration. Alternatively, the labyrinthine body is box-like having a single layer with a plurality of internal walls (eg six). This is an advantageous arrangement in terms of low cost and simplicity of construction and may be used as a wrist watch.

An opaque surface is conveniently positioned on the second face so that light transmitted through the pathways is visible. If desired, a further outer vertical layer of transparent material may be provided to form a face on the sundial.

A ray of light transmitted to the exit end may illuminate a pre-prepared surface at the second face. For example, the pre-prepared surface may comprise a plurality of exit ends patterned in the manner of a timepiece. Preferably, the timepiece is of the numeric type (eg digital-like or Roman numerals) permitting the time of day to be visibly indicated as the appropriately illuminated numeral on the second face. For example, the overall disposition of horizontal and vertical exit ends at the second face may comprise a box like "18" configuration which with appropriate illumination of one or more exit ends allows each of the requisite numerals 1 to 12 to be visibly indicated. Alternatively.there may be a series of horizontal, vertical and angled exit ends at the second face which with appropriate illumination permit each of the desired Roman numerals to be illuminated (eg the Roman numerals between IX in the morning to V in the evening).

In a further embodiment of the invention, the second face of the labyrinthine body may be arranged as a clock face. For this purpose, the labyrinthine body may be composed of a plurality of discrete layers comprising pathways constructed so that one or more exit ends illuminate an appropriate hour marker on the face of the clock (in accordance with the appropriate solar position).

By way of example, for a southerly directed first face at 1 pm British Standard Time, the pathways will be arranged to transmit rays of light, from the specific solar position at which the rays are incident at 90° to the first face so that the numeral one, I or an appropriate marker positioned at one o'clock on a clock face will be illuminated. At all other times, the numeral one, I or marker remains non-illuminated. A different pathway transmits light rays for each hour (ie in accordance with each solar position). Preferably the pathways will be positioned at angles differing by factors of about 15°.

Viewed from a yet further aspect the present invention provides a sundial for indicating the time of day using the position of the sun comprising a holographically prepared surface (eg a holographic plate) with a plurality of images which are activated by light from a specific solar position (or number of specific solar positions).

In a preferred embodiment, a holographic plate may comprise a series of images which are composed so that they are only visible in natural light when it is incident from a'specific direction. In this manner, a holographically prepared surface may be used to indicate the time through either a series of numbers or words representing the hours or a series of geometric shapes positioned to indicate the time on some sort of clock face.

Typically the sundial of the invention will be operable between the hours of nine o'clock in the morning and five o'clock in the evening. where appropriate (and particularly where the sundial is mobile eg as a wrist watch), the sundial may need to be provided with means for aligning the sundial in a Southerly direction (or 15° East or West of South depending on the time of year and the country of use). For example, a compass may be installed on or in the labyrinthine body.

The invention will now be described in a non-limitative sense with reference to the accompanying figures in which FIGS. 1 to 5 illustrate layers of a preferred embodiment of the sundial of the invention;

Figure 8A:
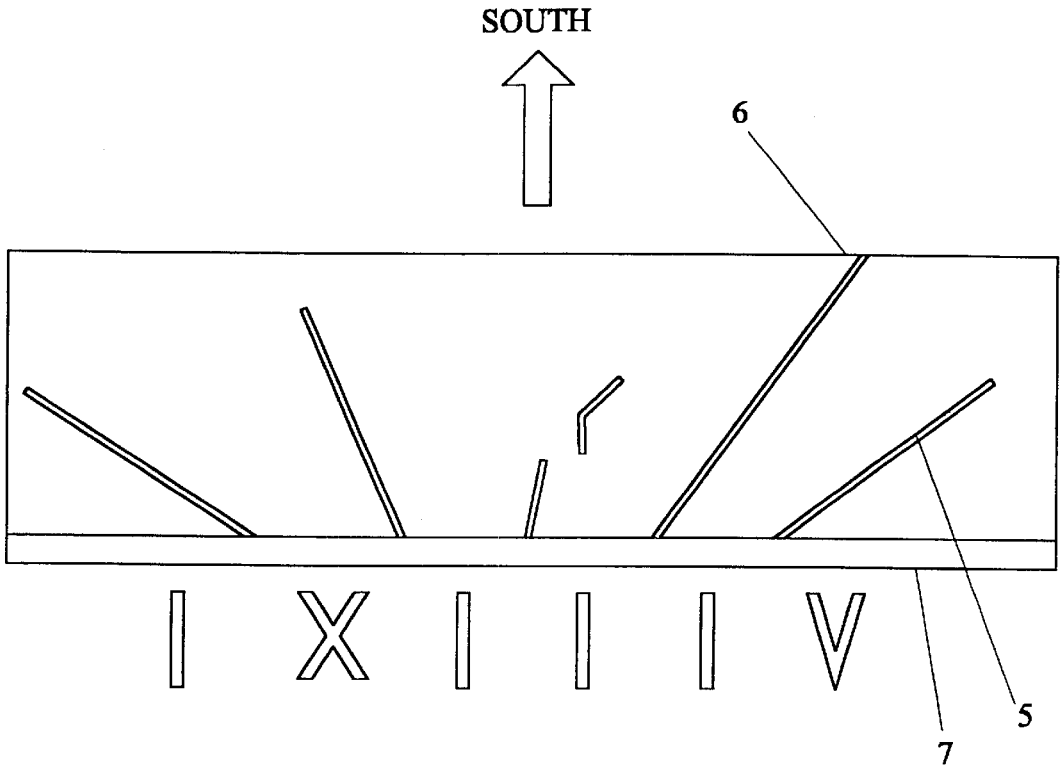
Figure 8B:
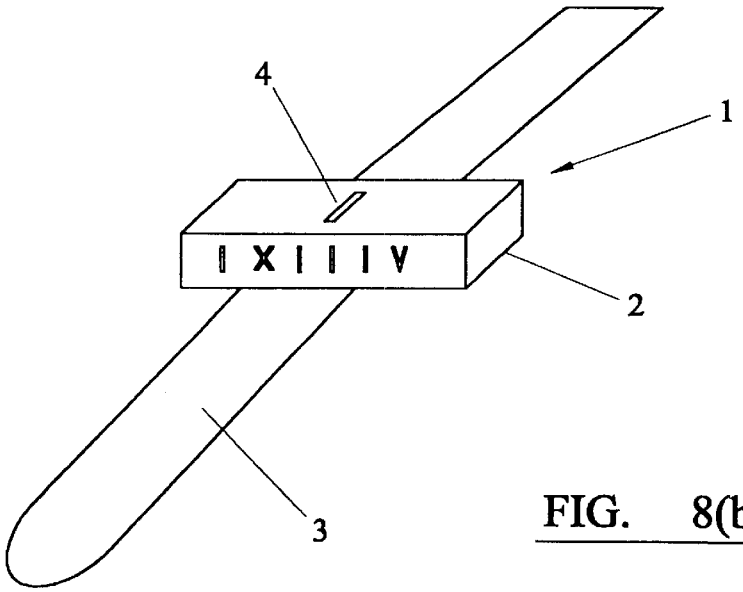

FIG. 8*a* and 8*b* illustrates a box-like embodiment of the invention which may be used as a wrist watch.

Figure 1:
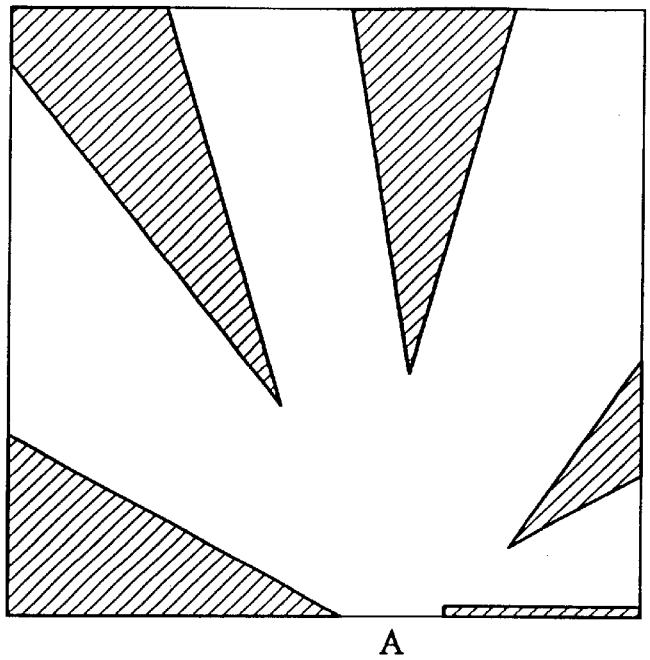
Figure 2:
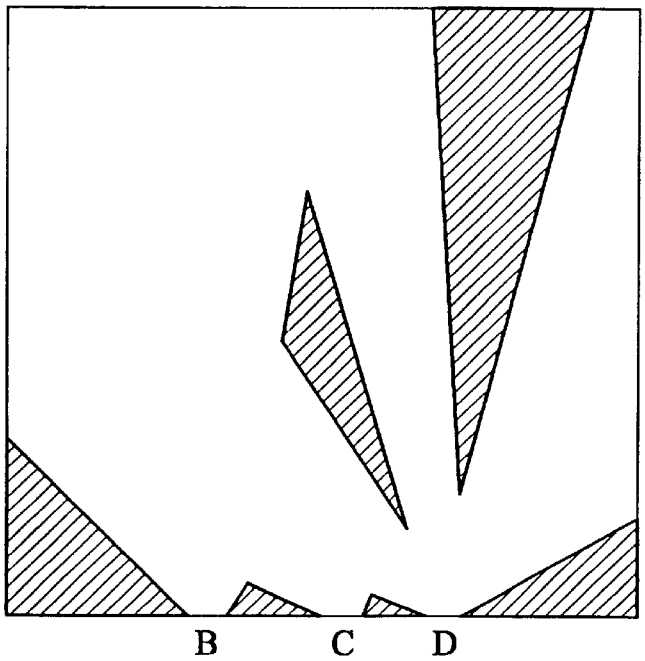
Figure 3:
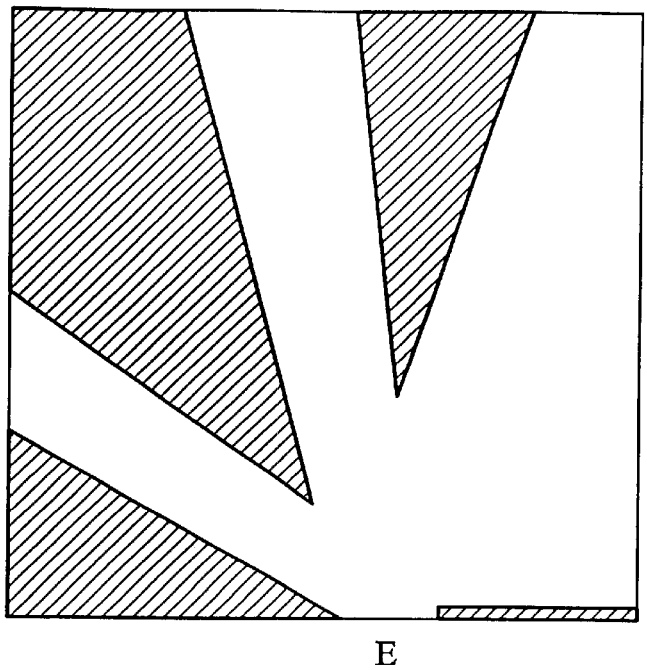
Figure 4:
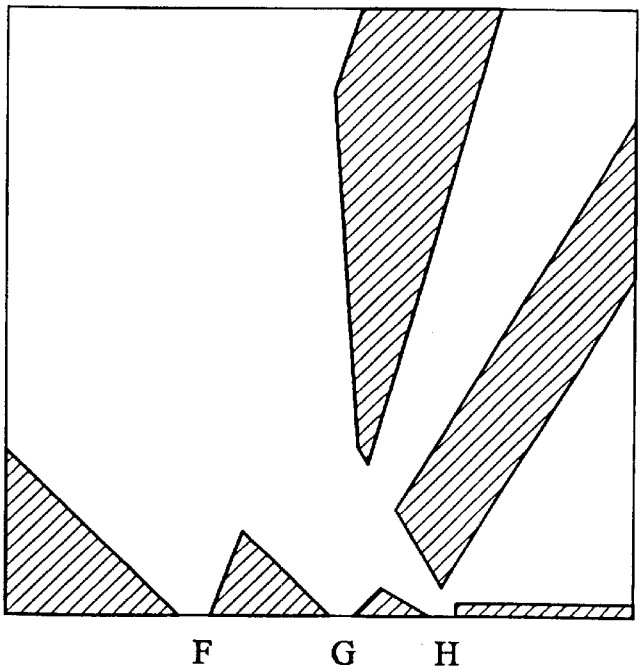
Figure 5:
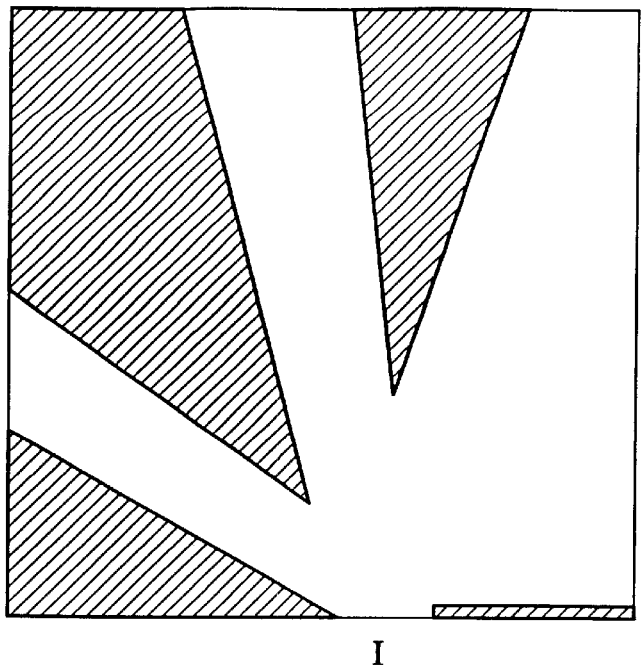
Figure 6:
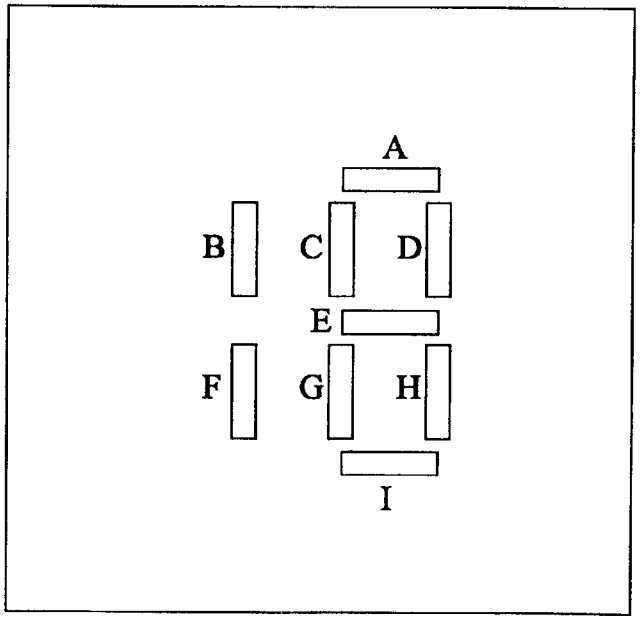
FIG. 6 illustrates a second face of an embodiment of the invention.
Figure 7:
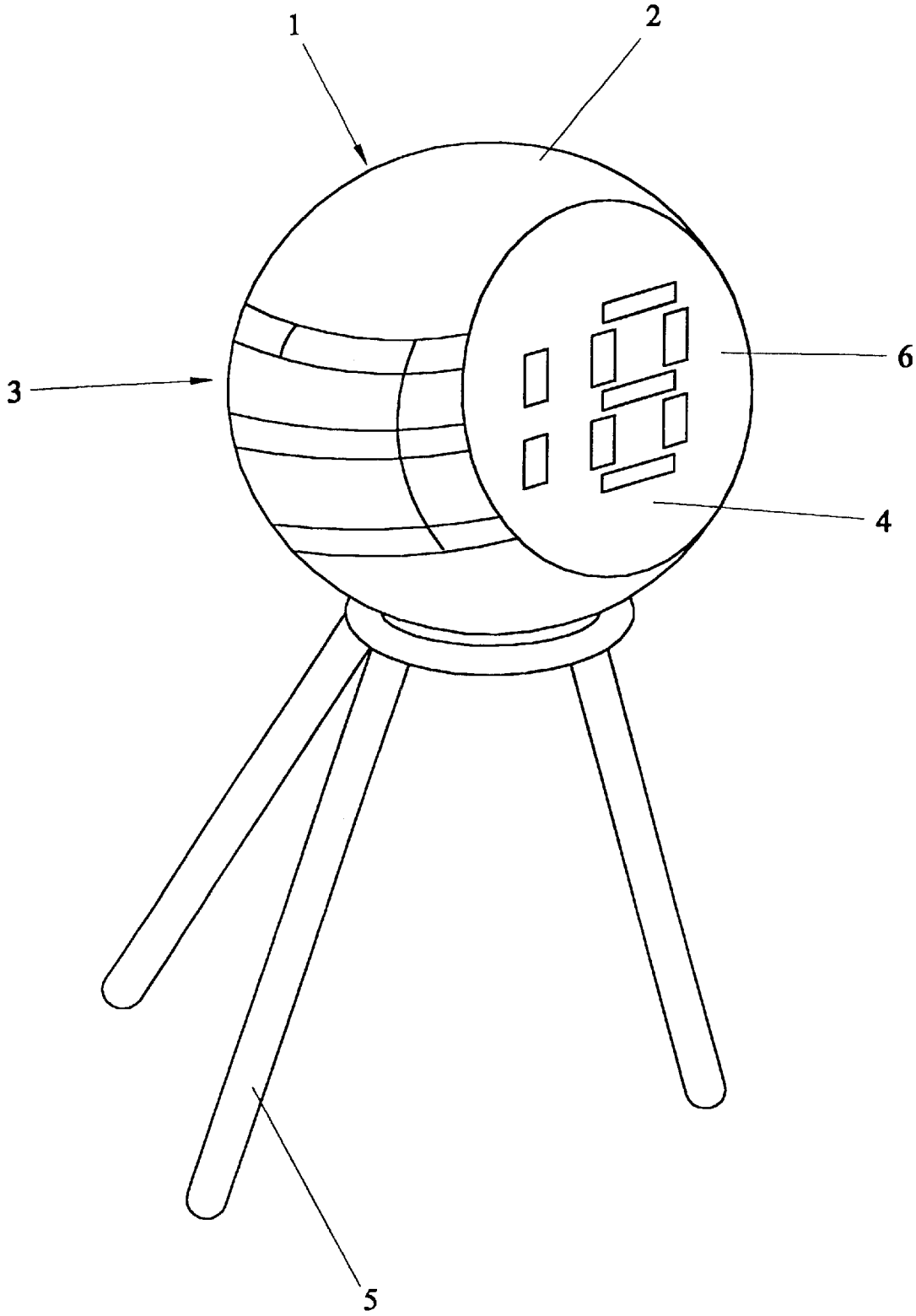
FIG. 7 illustrates in perspective view an embodiment of the invention.

FIG. 7 illustrates a sundial of the invention designated by reference numeral 1. The sundial comprises a labyrinthine body 2 of a generally spherical configuration having a first face 3 and a second face 4 which is provided at the exit end of the pathways in the labyrinthine body. The exit ends of these pathways are provided in the form of a box like 18 configuration which when suitably illuminated gives a visible. indication of the time of day. The sundial is supported on a tripod stand 5. FIG. 6 illustrates in more detail the second face of the sundial with the exit ends of the pathways (A to I discussed below) constructed to form a box like 18 configuration.

The sundial of FIG. 7 comprises seven discrete layers. The two outermost layers are non-functional. The five innermost layers are illustrated individually in FIGS. 1 to 5. Each layer comprises a particular arrangement of pathways with one or more exit ends A to I as indicated. Exit ends A, E and I are horizontal within the first, third and fifth layers of the innermost five layers. The exit ends B, C, D, G and H are vertical within the second and fourth layers of the innermost five layers. Together the exit ends A to I when appropriately illuminated may visibly indicate the time of day on the second face.

Each of the pathways is adapted to allow light to be transmitted from the first face to the second face in accordance with a specific (or more than one specific) solar position. At other times, the material from which the labyrinthine body is made will block light from passing through to the second face. For example, when the sun is incident on the first, southerly directed face 3 of the dial at an angle of 30°, rays of light may pass through all horizontal pathways (A, E and I) and three of the six vertical slits (C, D and H) so that a numeral 9 is illuminated on the second face. One hour later at an incident angle of 45°, all six vertical pathways (B, C, D, F, G and H) allow light to be transmitted through to the second face but only the horizontal pathways A and I are transmissive so that a numeral 10 is illuminated on the second face. In.this manner, each pathway is open or closed according to each hour of sunlight so that the hour figure is visible as a number on the second face. FIG. 8*b* illustrates a box-like labyrinthine body 2 in the form a sundial watch 1 with a strap 3. The body is provided with a window 4 through which may be viewed a magnetic needle or disc to enable the user to align the watch in a Southerly direction. As shown in a cross-sectional, top view in FIG. 8*a*, there is provided a plurality of pathways 5 to transmit light to the exit ends at the front face 7 and walls 6 to block light. In this manner, the exit ends permit the numerals IX in.the morning to V in the afternoon to be visibly displayed to designate the hour of the day.

What is claimed is:

1. A sundial for indicating the time of day using the position of the sun having a labyrinthine body comprising:

a first face capable of admitting a ray of light from each solar position in a substantially southerly direction;

a second face adapted to visibly receive said ray of light; wherein said labyrinthine body is provided with a plurality of pathways connecting said first and said second face, each pathway being adapted either to transmit said ray of light from an entry end at the first face to an exit end at the second face or to absorb said ray of light depending on the solar position, whereby the second face indicates visibly the time of day.

2. A sundial as claimed in claim 1 wherein the labyrinthine body comprises a plurality of discrete layers.

3. A sundial as claimed in claim 2 wherein each discrete layer comprises one or more pathways capable of transmitting a ray of light from one or more specific solar positions from the entry end to the exit end on the first and second faces of the sundial respectively.

4. A sundial as claimed in claim 3 wherein the pathways comprise tunnels or channels.

5. A sundial as claimed in claim 2 comprising separating means located intermediate each of the discrete layers of the labyrinthine body.

6. A sundial as claimed in claim 5 wherein the separating means are thin layers of material, the surface of which are reflective.

7. A sundial as claimed in claim 1 wherein the labyrinthine body comprises at least five discrete horizontal layers.

8. A sundial as claimed in claim 7 wherein the first, third and fifth layers each comprise a pathway constructed so that the exit ends are horizontally positioned substantially directly above one another on the second face of the sundial and the second and fourth layers each comprise three pathways constructed so that the exit ends are vertically positioned on the second face of the sundial.

9. A sundial as claimed in claim 7 wherein the labyrinthine body comprises seven layers wherein the outermost layers are provided for capping the five innermost layers.

10. A sundial as claimed in claim 1 wherein the labyrinthine body is a generally spherical configuration.

11. A sundial as claimed in claim 1 wherein the labyrinthine body is box-like having a single layer with a plurality of internal walls.

12. A sundial as claimed in claim 1 adapted for use as a wrist watch.

13. A sundial as claimed in claim 1 wherein an opaque surface is positioned on the second face so that light transmitted to the exit end is visible.

14. A sundial as claimed in claim 1 wherein a plurality of exit ends are patterned on the second face in the manner of a timepiece thereby permitting the time of day to be visibly indicated as an appropriately illuminated indicator on the second face.

15. A sundial as claimed in claim 14 wherein the timepiece is of the numeric type.

16. A sundial as claimed in claim 15 wherein the numeric type is digital or Romannumeric.

17. A sundial as claimed in claim 14 wherein the overall pattern of exit ends at the second face comprises a box-like "18" configuration which with appropriate illumination of one or more exit ends allows each of the requisite numerals 1 to 12 to be visibly indicated.

18. A sundial as claimed in claim 14 comprising a series of horizontal, vertical and angled exit ends at the second face which with appropriate illumination permit each of the desired Roman numerals to be illuminated.

19. A sundial as claimed in claim 14 wherein the second face of the labyrinthine body may be arranged as a clock face.

20. A sundial as claimed in claim 1 wherein the pathways will be positioned at angles differing by factors of about 15°.

21. A sundial as claimed in claim 1 which is operable between the hours of nine o'clock in the morning and five o'clock in the evening.

22. A sundial as claimed in claim 1 comprising means for aligning the labyrinthine body in a Southerly direction or 15° East or West of the Southerly direction depending on the time of year and the country of use.

23. A sundial as claimed in claim 22 wherein the means for aligning is a comrpass installed on or in the labyrinthine body.

* * * * *